US007406292B2

(12) United States Patent
Kamiyama

(10) Patent No.: US 7,406,292 B2
(45) Date of Patent: Jul. 29, 2008

(54) IMAGE FORMING APPARATUS AND FIXING DEVICE

(75) Inventor: Nobuto Kamiyama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 330 days.

(21) Appl. No.: 11/408,476

(22) Filed: Apr. 21, 2006

(65) Prior Publication Data

US 2006/0245795 A1 Nov. 2, 2006

(30) Foreign Application Priority Data

Apr. 28, 2005 (JP) ..... 2005-131836

(51) Int. Cl.
*G03G 15/20* (2006.01)

(52) U.S. Cl. ..... 399/406; 399/322

(58) Field of Classification Search ..... 399/322, 399/406, 401, 68
See application file for complete search history.

(56) References Cited

U.S. PATENT DOCUMENTS 5,842,105 A * 11/1998 Acquaviva ..... 399/406
5,848,347 A * 12/1998 Kuo et al. ..... 399/406
5,905,934 A 5/1999 Koshimizu

FOREIGN PATENT DOCUMENTS

JP 5-158364 A 6/1993
JP 7-191564 A 7/1995
JP 9-301599 A 11/1997

* cited by examiner

*Primary Examiner*—Susan S Lee
(74) *Attorney, Agent, or Firm*—Canon USA Inc IP Div

(57) ABSTRACT

An image forming apparatus a first fixing device fixing the toner image on the sheet; a second fixing device fixing the toner image, fixed on the sheet by the first fixing device; a fixing conveyance path guiding the sheet carrying the toner image fixed by the second fixing device; a detour conveyance path diverging from the fixing conveyance path on an upstream side of the second fixing device, and joining the fixing conveyance path at a joining point on a downstream side of the second fixing device so that the sheet is guided detouring the second fixing device; a joined conveyance path guiding the sheet on a downstream side of the joining point; a first curl applying unit disposed on the joined conveyance path and applying a curl to the sheet; and a second curl applying unit disposed on the detour conveyance path and applying a curl to the sheet.

13 Claims, 11 Drawing Sheets

IMAGE FORMING APPARATUS AND FIXING DEVICE

BACKGROUND OF THE INVENTION

1. Field of the Invention

The present invention relates to an image forming apparatus that forms an image on a sheet, and a fixing device that fixes a toner image on the sheet.

2. Description of the Related Art

In the image forming apparatus, a toner image is fixed on a sheet surface by the fixing device which heats and applies pressure to the toner image formed on the sheet. When the sheet carrying the toner image passes through the fixing device, the sheet is arched on an image formed side due to heat contraction of the toner (hereinafter this phenomenon is referred to as toner curl). On the other hand, at a marginal portion of the sheet where there is no toner image or at a portion of the sheet bearing a relatively small amount of toner, moisture is evaporated from the sheet due to heat of the fixing device which results in an arch formation in a direction opposite to the image formed surface (hereinafter this phenomenon is referred to as heat curl).

Dimension, shape, and direction of the two curl types change depending on various factors such as shapes of conveyance path inside the image forming apparatus, sheet size or a sheet making direction, fixing temperatures of the fixing apparatus, and toner type. Moreover, in addition to the above factors, the curl form changes depending on the toner image type and is also influenced by the environment where the apparatus is in use.

When the sheet is curled, a paper jam can occur at the conveyance path downstream of the fixing device or loading failure can occur due to the curl of the discharged sheet. Moreover, the image forming apparatus can have two-sided conveyance path for conveying a sheet to the image forming unit again to form the image on a second surface of the sheet after the image is formed on a first surface. In such apparatus, transfer failure may occur due to the curl, or the sheet fails to enter the fixing device, when an image is transferred onto the second surface.

Conventionally, a method of correcting the curl has been proposed in which a curl correcting unit is provided downstream of the fixing device for correcting the curl generated in the fixing device, and the transfer or conveyance failure downstream of the conveyance path is reduced (refer to Japanese Patent Application laid-open No. 9-301599, corresponding to U.S. Pat. No. 5,905,934). As a method of dealing with the differences in the curl level depending on the paper types and environments, there is an apparatus configured to adjust the curl correcting capability (refer to Japanese laid-open Application No. Hei 8-169615) or make the apparatus attachable/detachable. Moreover, there is a known mechanism to correct the two curl types (i.e., the toner curl and heat curl). Since both curls are generated in the opposite directions, in order to correct both curls, the downstream of the conveyance path in the fixing device is diverged, and the curl correcting units operating in opposite directions are disposed in the respective conveyance paths.

In the conventional apparatus, between the two curl types described above, the effect of the heat curl is especially large, and therefore, the curl correction is performed to all recording media mostly by disposing the curl correcting unit downstream of the fixing device. Nevertheless, since the curl formation varies depending on the sheet types and images as described above, there are cases where the curl cannot be corrected depending on the sheet types, or in some cases, the curl is corrected more than necessary. Especially, along with recent emergence of the high-speed apparatus market, the fixing temperature is set higher than before, and the applied pressure is being increased. As a result, a level of curl tends to get higher than the conventional machines, especially because the curl of the thin sheet becomes larger. This causes the problem that the sheet cannot enter the fixing device when the image is fixed on the second surface in a two-sided printing. Accordingly, the curl must be corrected and reduced.

Further, there is a problem that a configuration for skew registration employed for high speed operation shows a tendency to be weak against the curl compared to the conventional registration configuration. Moreover, in addition to the high speed, along with rising request for high image quality, in order to remove a trace on the image, a long roller is frequently disposed downstream of the fixing device. The long roller has a cylinder portion which is longer than the sheet width. However, in the case of employing the long roller, a gap is formed between a guiding board and the roller, so that paper jam occurs if the level of curl is not smaller than in the conventional machines.

In this regard, for example, when a curl correction unit in the two-sided conveyance path is devised to correct curling, large pressure must be applied to correct a thin paper at a lowered temperature. However, by applying large pressure, an image surface of the sheet may be damaged or wrinkled. Moreover, for example, when a curl correcting unit corrects a curl immediately after the fixing device, it is possible to apply a large curl to the sheet because the sheet temperature is high. However, depending on the sheet types, the curl can be generated more than necessary, or the image can be damaged if a large pressure is applied immediately after fixing. Adjustment of the curl correcting capability or the attachment/detachment mechanism is employed to deal with changes in the level of curls depending on the sheet types. Furthermore, the attachment/detachment and adjustment between the sheets are performed by a motor or solenoid in the high speed apparatus. However, it is not easily implemented because the apparatus and sequence become complex, and good durability is not obtained.

On the other hand, a number of sheet types used by the image forming apparatus is increasing. Therefore, it is difficult to fix the image with stability on all kinds of sheets in the image forming apparatus in which an image is fixed using a single fixing device. Therefore, a configuration is considered in which an image is fixed on the sheet using a plurality of fixing devices which are aligned serially in the conveyance path (refer to Japanese Patent Application laid-open Nos. 5-158364 and 7-191564). Also in this image forming apparatus that employs the plurality of fixing devices to secure stable fixing, there appears the problem relating to the curl correction as described above when the sheet conveyance is carried out at high speed.

SUMMARY OF THE INVENTION

The present invention is directed to appropriately performing curl correction by using a plurality of fixing devices, in an apparatus that fixes an image on a sheet. According to one aspect of the present invention, an image forming apparatus, includes: an image forming unit configured to form a toner image on a sheet; a first fixing device that fixes the toner image formed onto the sheet by the image forming unit; a second fixing device that fixes the toner image again on the sheet carrying the toner image fixed by the first fixing device; a fixing conveyance path that guides the sheet carrying the toner image fixed by the second fixing device; a detour conveyance path that diverges from the fixing conveyance path on an upstream side of the second fixing device of the fixing conveyance path, and joins to the fixing conveyance path at a joining point on a downstream side of the second fixing device so that the sheet is guided detouring the second fixing device; a joined conveyance path that guides the sheet on a downstream side of the joining point; a first curl applying unit that is disposed on the joined conveyance path and applies a curl to the sheet; and a second curl applying unit that is disposed on the detour conveyance path and applies a curl to the sheet.

According to another aspect of the present invention, a fixing device for fixing a toner image formed on a sheet, includes: a first conveyance path where the sheet passes through; a first fixing device that fixes the toner image on the sheet passing through the first conveyance path and a second fixing device on a downstream side of the first fixing device; a second conveyance path that diverges from the first conveyance path between the first fixing device and the second fixing device, and joins to the first conveyance path at a joining point on a downstream side of the second fixing device; a joined conveyance path where a sheet having passed through the first conveyance path and a sheet having passed through the second conveyance path pass, on a downstream side of the joining point; a first curl applying apparatus that is disposed on the joined conveyance path and applies a curl to the sheet; and a second curl applying apparatus that is disposed on the second conveyance path and applies a curl to the sheet.

Further features of the present invention will become apparent from the following detailed description of exemplary embodiments with reference to the applied drawings.

BRIEF DESCRIPTION OF THE DRAWINGS

The accompanying drawings, which are incorporated in and constitute apart of the specification, illustrate exemplary embodiments of the invention and, together with the description, serve to explain the principles of the invention.

DETAILED DESCRIPTION OF THE EXEMPLARY EMBODIMENTS

Embodiments of the invention will be described in detail below with reference to the drawings.

First Exemplary Embodiment

Figure 1:
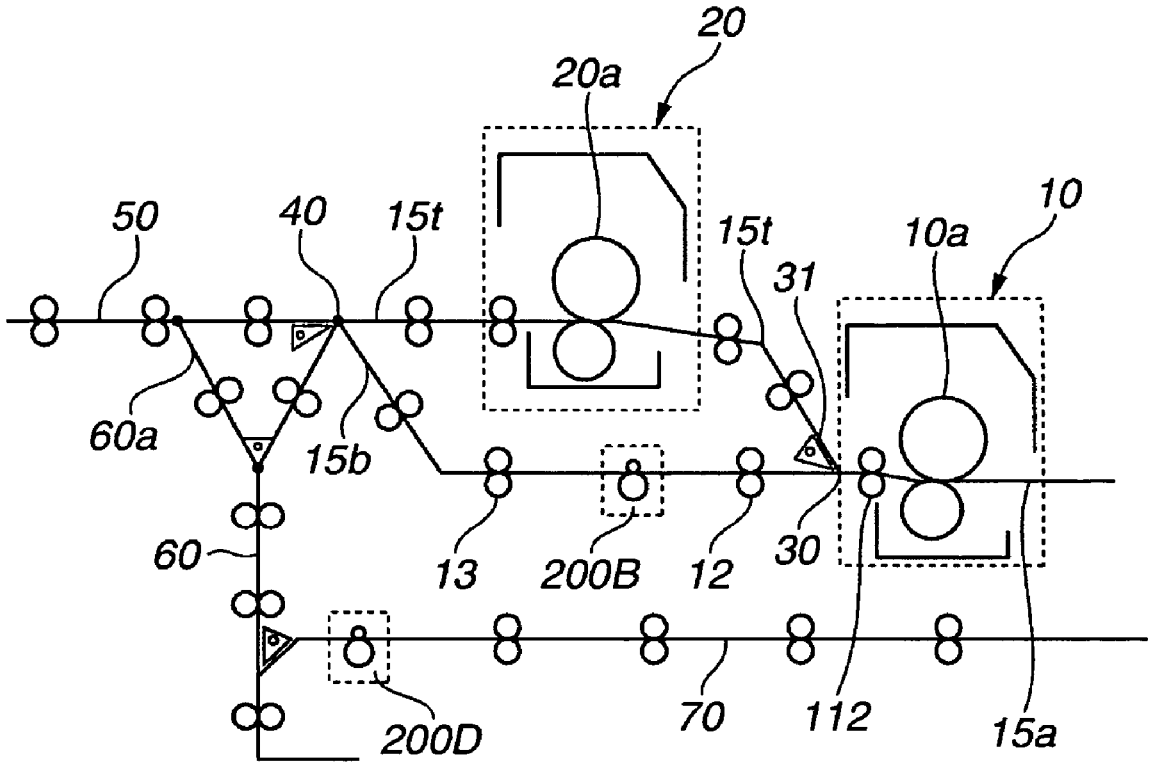
FIG. 1 is a schematic drawing of conveyance unit around the fixing device in accordance with a first exemplary embodiment.
Figure 10:
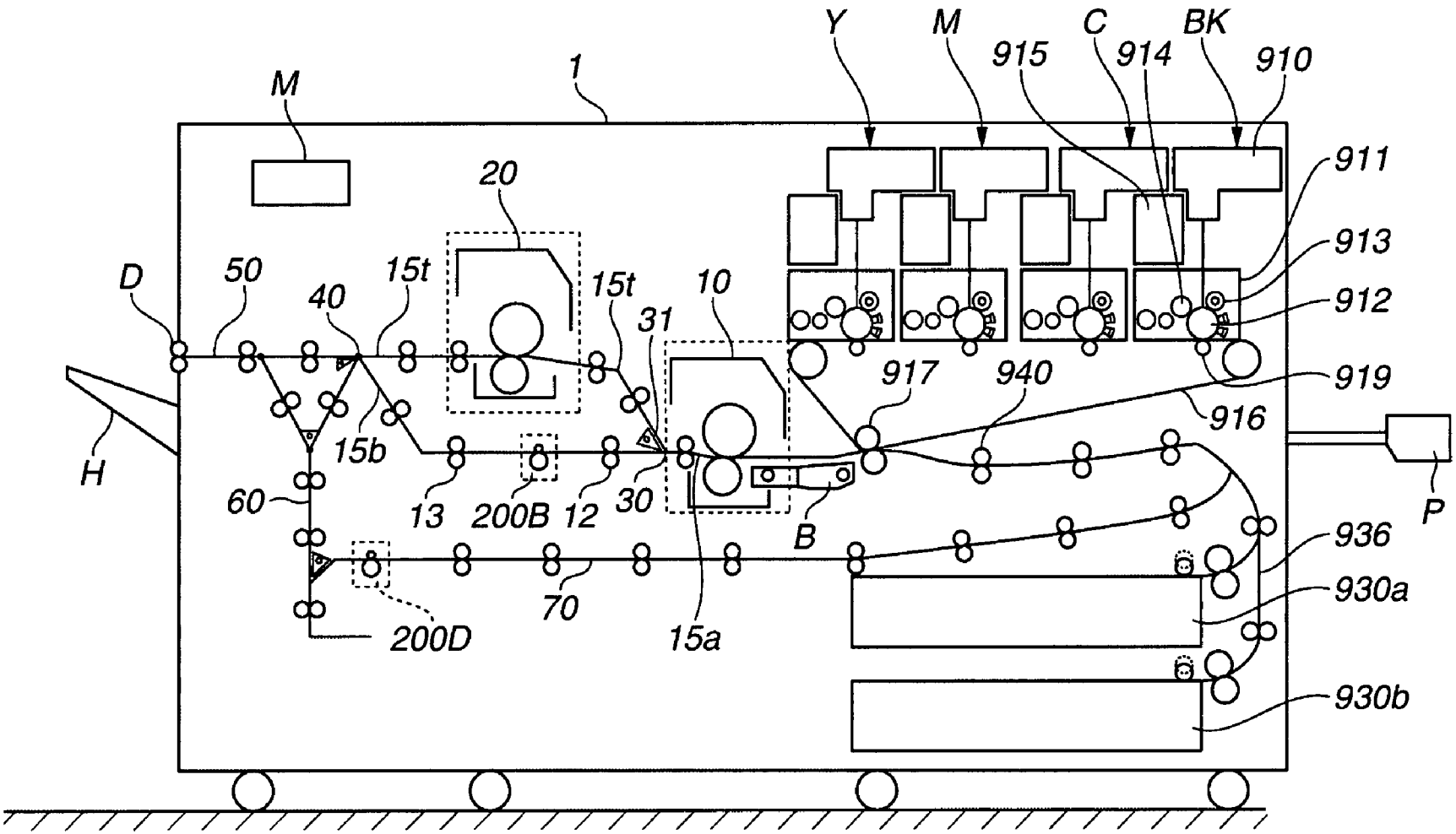
FIG. 10 is a cross sectional drawing of the image forming apparatus in accordance with the first exemplary embodiment.

FIG. 10 is a schematic drawing of a cross section of an image forming apparatus in accordance with a first exemplary embodiment. FIG. 1 is a schematic drawing of a conveyance unit around a fixing device in accordance with the first exemplary embodiment.

Primary image forming units Y, M, C, Bk for forming images of respective colors of yellow, magenta, cyan and black are disposed on an upper part of the image forming apparatus 1. Print data transmitted from an external device such as a personal computer is received by a controller M that controls the printer 1, which outputs the received data to a laser scanner 910 of each color as write image data.

The laser scanner 910 emits a laser to a photosensitive drum 912, and renders an optical image in accordance with the write image data.

A primary image forming unit 911 includes the photosensitive drum 912 and a charger 913 for implementing a uniform charge on a surface of the photosensitive drum 912. The primary image forming unit further includes a developing unit 914, a toner storing unit 915, a primary transfer roller 919, and a cleaner (not shown). A static latent image is formed on the surface of the photosensitive drum 912 charged by the charger 913 using the laser scanner 910, that renders the optical image. The developing unit 914 develops the static latent image to a toner image that is transferred to an intermediate transfer belt 916. The toner storing unit 915 stores a toner with which the developing unit 914 develops an image. The primary transfer roller 919 transfers the toner image developed on the surface of the photosensitive drum 912 to the intermediate transfer belt 916. The cleaner (not illustrated) removes the remaining toner on the photosensitive drum 912.

In FIG. 10, a reference numeral is assigned to a primary image forming unit Bk forming a black image for the sake of description. However, the same configuration as the black primary image forming unit Bk is provided for all of a yellow primary image forming unit Y, a magenta primary image forming unit M, and a cyan primary image forming unit C. The toner image of each color is transferred on the intermediate transfer belt 916 by the primary image forming units Y, M, C, and Bk, respectively. That is, onto an outer surface of the intermediate transfer belt 916, the primary image forming units Y, M, C, and Bk superimpose and transfer toner images successively, and the resultant color toner image corresponding to the subject color image is formed at the outer surface of the intermediate transfer belt 916.

The resultant color toner image that was primarily transferred to the intermediate transfer belt 916 is transferred onto the sheet at a second transfer roller 917. The image forming unit include the primary image forming units Y, M, C, Bk for forming the primary image, the intermediate transfer belt 916, and the secondary transfer roller 917, and the like.

Downstream of the secondary transfer roller 917, a conveyance belt B is disposed that conveys a sheet carrying an image formed by the image forming unit to a first fixing device 10 which will be described below.

Two-tiered sheet supplying units 930 are arranged in a most upstream part of the sheet conveyance system, below the image forming apparatus (930*a* and 930*b*). The sheet supplied from the sheet supplying units 930*a* and 930*b* is conveyed to a downstream side through a vertical conveyance path 936. A registration roller pair 940 is arranged in the most downstream part of the vertical conveyance path 936. The registration roller pair 940 performs final sheet skew correction, writes the image at the image forming unit, and adjusts a sheet conveyance timing.

A first fixing conveyance path 15*a* is disposed on a downstream side of the image forming unit where the sheet passes through. The first fixing device 10 is disposed on the first fixing conveyance path 15*a*, that fixes a toner image on the sheet S as a permanent image. That is, the first fixing device 10 fixes an image on the sheet guided by the first fixing conveyance path 15*a*.

A second fixing device 20 is disposed on a downstream side of the first fixing device 10, that fixes the image again on the sheet which has passed through the first fixing device 10.

The first fixing device 10 includes a first fixing roller pair 10*a*. The first fixing device 10 fixes on the sheet a toner image transferred by the image forming unit under a sandwiching pressure of the first fixing roller pair 10*a* and heat from the heater.

The second fixing device 20 includes a second fixing roller pair 20*a*. The second fixing device 20 fixes on the sheet a toner image transferred by the image forming unit under a sandwiching pressure of the second fixing roller pair 20*a* and heat from the heater.

The second fixing device and a second fixing conveyance path 15*t* are arranged on the downstream side of the first fixing device 10. Moreover, a detour conveyance path 15*b* is disposed on the downstream side of the first fixing device 10. The detour conveyance path 15*b* diverges from a diverging point 30 disposed on an upstream side of the second fixing device 20 on the second fixing conveyance path 15*t*. The detour conveyance path 15*b* is adapted to guide the sheet so as to detour the second fixing device 20.

The diverging point 30 includes a rotatable flapper 31. The flapper 31, which is a conveyance path switching member, guides the sheet to either one of the second fixing conveyance path 15*t* and the detour conveyance path 15*b*. Rotation of the flapper 31 is controlled by a control unit M according to the sheet types. The second fixing conveyance path 15*t* and the detour conveyance path 15*b* join again at a joining point 40 which is located on a downstream side of the second fixing device 20.

A detour path curl applying unit 200B is disposed on the detour conveyance path 15*b* as a second curl applying apparatus according to the present exemplary embodiment.

A reverse conveyance path 60 for reversing the sheet is disposed on a downstream side of the joining point 40. The sheet which has been reversed by the reverse conveyance path 60 is guided to a two-sided conveyance path 70 or a reverse discharge path 60*a*. A sheet with a formed image on the front surface passes through the two-sided conveyance path 70. In the case that the reversed sheet is discharged out of the apparatus, the reversed sheet which is conveyed toward a sheet discharge conveyance path 50 passes through a reverse discharge path 60*a*. The sheet is conveyed again to the image forming unit to form an image on the rear surface of the sheet. The reverse conveyance path 60 and the two-sided print conveyance path 70 function as a joined conveyance path. The joined conveyance path guides a sheet that passed through the fixing conveyance path 15*t* and a sheet that passed through the detour conveyance path 15*b*, on the downstream side of the merging point 40.

The two-sided conveyance path 70 includes a curl applying unit 200D that is arranged around the entrance of the two-sided conveyance path 70. The curl applying unit 200D serves as a first curl applying apparatus according to the present exemplary embodiment.

Operation of the image forming apparatus 1 is explained next.

The sheet supplied from the sheet supplying unit 930 is conveyed through the vertical conveyance path 936 to the registration roller pair 940. The registration roller pair 940 conveys the sheet to the secondary transfer roller 917. The secondary transfer roller 917 transfers the toner image on the intermediate transfer belt 916 onto the sheet while the sheet is being conveyed.

The transferred toner image on the sheet is conveyed by the transfer belt B to the first fixing device 10 passing through the first fixing conveyance path 15*a*. The second fixing conveyance path 15*t* heading towards the second fixing device 20 and the detour conveyance path 15*b* detouring the second fixing device 20 are disposed on the downstream side of the first fixing device 11. The sheet carrying the image fixed by the first fixing device 10 is guided to either one of the second fixing device conveyance path 15*t* and the detour conveyance path 15*b* detouring the second fixing device 20, by the flapper 31. As already described, the joining point 40 is provided at an end terminal of the detour conveyance path 15*b* and on the downstream side of the second fixing device 20 on the second fixing conveyance path 15*t*. The sheet guided to the second fixing conveyance path 15*t* is conveyed to the joining point 40 after the toner image is again fixed by the second fixing device 20. The sheet guided to the detour conveyance path 15*b* is conveyed to the joining point 40 detouring the second fixing device 20.

On the downstream side of the joining point 40, in the case of one-sided printing, the sheet passes through a sheet discharge conveyance path 50 heading in a sheet discharge direction, and is discharged on a sheet discharge tray H by a sheet discharge roller pair D. On the other hand, in the case of two-sided printing, the sheet is conveyed to the reverse conveyance path 60 heading toward the two-sided conveyance path 70, and then conveyed to the two-sided conveyance path 70 after exchanging a leading and trailing edge of the sheet at the reverse conveyance path 60.

Either procedure of passing the sheet through the second fixing device 20 or passing through the detouring conveyance path 15*b* detouring the second fixing device 20 is selected. The selection will be described below.

The second fixing conveyance path 15*t* and the detour conveyance path 15*b* are used separately depending on the paper weight in gsm, types, and the like, of the conveyed sheet S. In the present exemplary embodiment, a thick sheet and a thick coated sheet are conveyed to the second fixing conveyance path 15*t*. A thin sheet and a thin coated sheet are conveyed to the detour conveyance path 15*b*. Which conveyance path should be taken is decided depending on the fixability of the image, the image gloss, the conveyance property, and the like.

When the user manipulates an operation unit P and selects the thick paper or the thick coated paper, the sheet is conveyed to the second fixing device 20. When the user manipulates the operation unit P and selects the thin paper or the thin coated paper, the sheet is conveyed to the detour conveyance path 15*b*. The control unit M decides which conveyance path to select according to the manipulation of the operation unit P. The control unit M controls the flapper 31 and the like, and thus, the sheet conveyance is controlled.

The control unit M controls the rotation of the flapper 31 as follows. The sheet is guided to the second fixing conveyance path 15*t* when an image is formed on the thick sheet. The sheet is guided to the detour conveyance path 15*b* when an image is formed on a sheet thinner than the thick sheet.

According to the above configuration, the apparatus recognizes the sheet type from the manipulation of the operation unit P. Alternatively, a sheet type detecting unit can be employed that detects the sheet type on the sheet conveyance path, and the control unit M recognizes the sheet type based on the sheet type detecting unit.

Further, in order to achieve the image quality and gloss as the user desires, the user themselves may decide which conveyance path should be taken, depending on the circumstances.

In general, the sheet S conveyed in the image forming apparatus is frequently represented as thin paper or thick paper, considering its paper weight in gsm. The thin paper described above in the present exemplary embodiment is normal paper having the paper weight ranging from 64 to 150 g/m$^2$. The thick paper is the normal paper having the paper weight ranging from 160 to 300 g/m$^2$. Moreover, the thin coated paper is the coated paper having the paper weight ranging from 80 to 105 g/m$^2$. The thick coated paper is the coated paper having the paper weight ranging from 128 to 300 g/m$^2$. As described above, the thickness of the sheet is not limited to these values since which conveyance path should be taken by the sheet is decided depending on the fixability of the image, the image gloss, the conveyance property, and the like.

Figure 2:
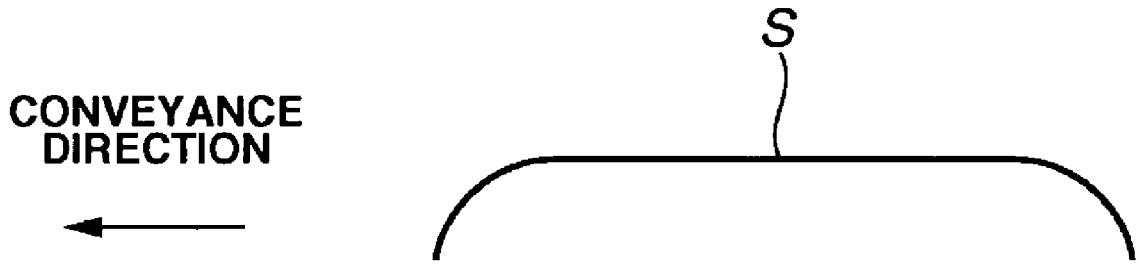
FIG. 2 is a drawing that explains the curled up state of the sheet S.
Figure 3:
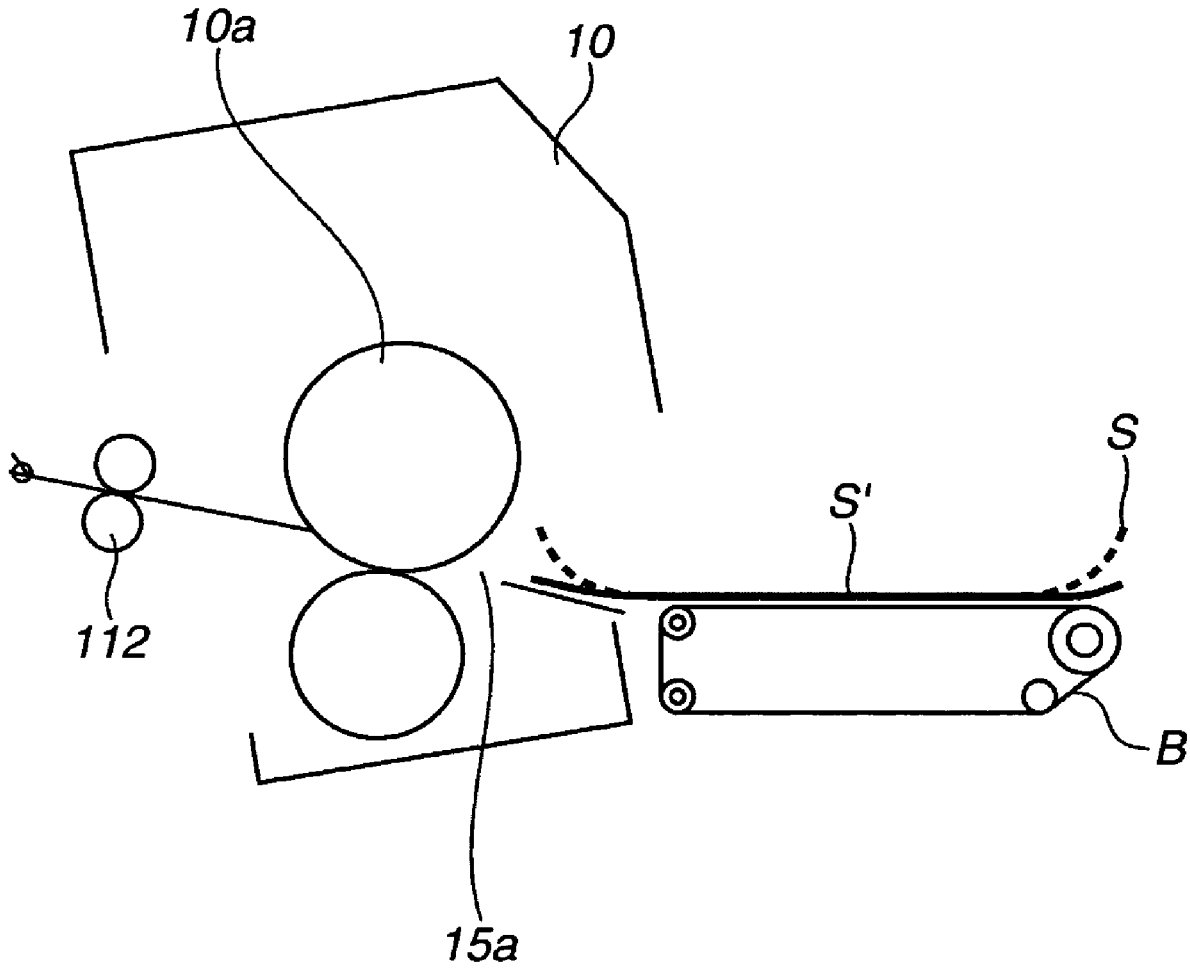
FIG. 3 is a schematic drawing of a first fixing device and a periphery of the first fixing device in accordance with the first exemplary embodiment.

When the toner image is fixed in the first fixing device 10, the heat curl is such that the sheet is curled in a downward direction as shown in FIG. 2. Because a quick fix capability is desired in high-speed machines, the fixing temperature and applied pressure are set higher than the conventional model. Therefore, compared to the conventional low-speed machines, the thin paper and the thin coated paper which can be easily curled, tend to be curled much more. Because of this tendency, when the sheet S carrying the formed image on the first surface passes through the two-sided conveyance path 70 and is again conveyed to the first fixing apparatus, it runs up against the fixing roller 10*a* due to the large curl so that a paper jam occurs, or the image may be displaced (refer to FIGS. 2 and 3). Thus, the curl of the sheet S needs be corrected as shown in S' of FIG. 3.

The curl applying unit 200B in the detour path, which is provided at the detour conveyance path 15*b*, is arranged on the downstream side of the detour conveyance roller 12. Further, the detour conveyance roller 12 is disposed on the downstream side of an inner discharge roller 112 which is located at the downstream side of the first fixing device 10.

In a case of the thin paper, the curl correction is effective if the sheet S is corrected while it is still warm. However, the sheet can be curled more than necessary depending on the paper type especially when thin paper is used and positioned too close to the fixing device 10. In the present exemplary embodiment, the curl applying unit 200B on the detour conveyance path 15*b* is disposed such that the inner paper discharge roller 112 and the detour conveyance roller 12 are sandwiched between the fixing device 10 and the detour path curl attaching unit 200B. Thus, according to the present exemplary embodiment, the heat is removed to some extent from the sheet S heated by the first fixing device 10 by the two pairs of rollers and then the sheet is curled. If there are too many roller pairs between the curl applying unit 200B on the detour path and the fixing device 10, the curl correction cannot be performed efficiently because the excessive heat is removed. Consequently, a number of the roller pairs for conveying the sheet between the first fixing device 10 and the detour path curl applying unit 200B is not more than two. In the present exemplary embodiment, two roller pairs are disposed between the detour path curl applying unit 200B and the fixing device 10. After the curl has been applied to the sheet passing through the detour conveyance path 15*b* by the detour path curl applying unit 200B, the curl is further applied by the two-sided conveyance path curl applying unit 200D which is disposed around the entrance of a two-sided conveyance path 70. As a result, the curl can be corrected appropriately.

In the case of the thick paper, the sheet passes through the second fixing device 20, and the heat does not easily escape from the sheet itself. Accordingly, there is no problem in terms of the curl correction even when the sheet passes through a number of roller pairs before reaching the two-sided conveyance curl applying unit 200D. Further, because the roller pairs 12 and 13 on the detour conveyance path 15*b* are the long rollers, which have a longer cylinder portion than the sheet width, the heat is easily removed from the sheet in contrast to other conveyance rollers.

The thin paper which passed through the detour path curl applying unit 200B on the detour conveyance path 15*b*, or the thick paper which passed through the second fixing device 20, joins at the joining point 40, and is conveyed to the two-sided conveyance path 70. In some cases, depending on the sheet type, the curl of the thin paper cannot be sufficiently corrected only by the detour path curl applying unit 200B. Accordingly, after the curl of the thin paper is corrected by the detour path curl applying unit 200B, the curl is again corrected by the two-sided conveyance path curl applying unit 200D. The curl of the thick paper is corrected at the two-sided conveyance path curl applying unit 200D, and is conveyed through the two-sided conveyance path 70.

Each of the two curl applying units 200B and 200D includes an iron roller 204 as a hard material and a sponge roller 203 as a soft material respectively.

Figure 4:
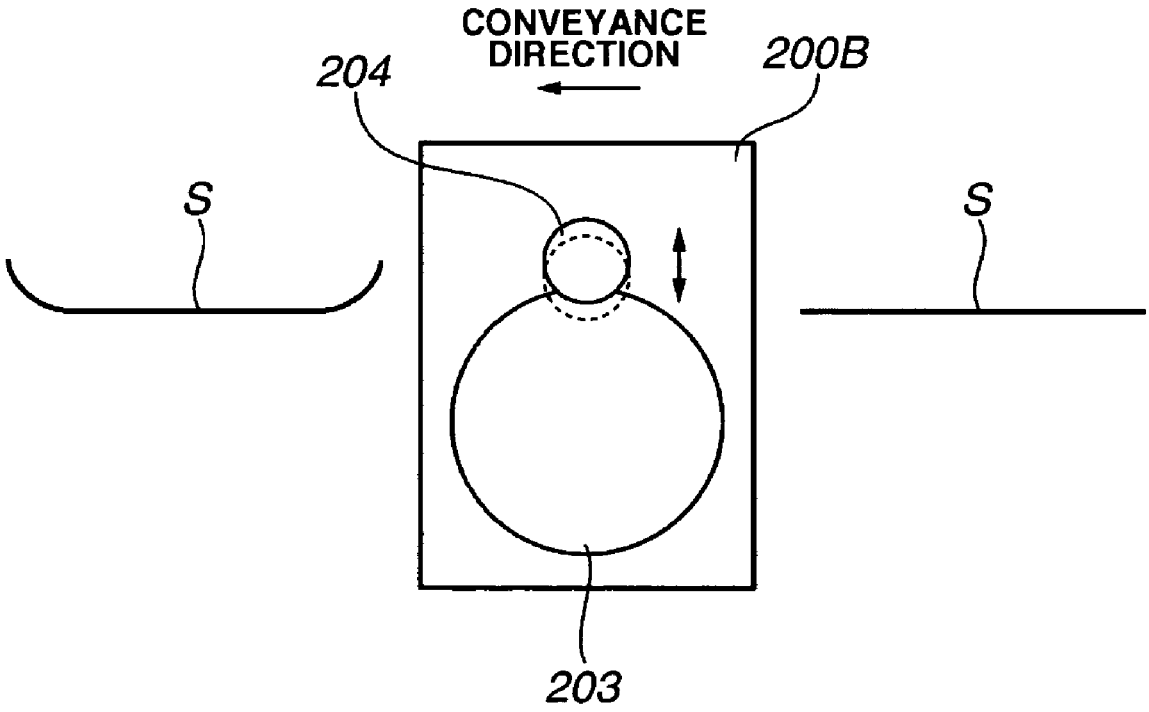
FIG. 4 is a detailed drawing of a curl applying unit in accordance with the first exemplary embodiment.

Further, as shown in FIG. 4, the present exemplary embodiment can be configured to adjust the curl applying capability by entering the iron roller 204 stepwise into the sponge roller 203. The curl level can be optimally controlled against various paper types and images by combining the two curl applying units and by changing the curl applying capability. Thus, the curl that may fail to enter the fixing device 10 when fixing the second time, is sufficiently corrected. Moreover, a registration precision is improved owing to this curl correction, and an image position accuracy is also improved.

According to the present exemplary embodiment, the detour path curl applying unit 200B is disposed on the detour conveyance path 15*b*, and the curl is effectively applied to the thin paper having a large curl by conducting the curl correction while the sheet temperature is still high. Moreover, the two-sided conveyance path curl applying unit 200D is disposed on the downstream side of the joining point 40. By adding the curl applying unit 200D responsive to the difference in the curl level of the sheet types, the large curl of the thin paper can be corrected at the detour path curl applying unit 200B. The curl correction is conducted further for the thin paper at the two-sided conveyance path curl applying unit 200D where the curl correction is also conducted for the thick paper. Owing to these effects, an appropriate curl correction can be conducted to the thick paper as well as the thin paper which is larger in size than the conventional model, without, for example, attaching/detaching or adjusting the curl correction capability at the two-sided conveyance path curl applying unit 200D. Consequently, the conventional problem of the failure in entering the sheet into the fixing device is improved, and a high-speed operation can be achieved. Along with this improvement, the precision in conveying the sheet to the image forming unit again, the registration precision on the second surface and the transfer precision are also improved, and a high quality image is achieved. In this embodiment, a curl correction amount of the detour path curl applying unit 200B is changed in according to the amount of the toner in a sheet. The control unit M controls the amount of going into the sponge roller 203 of the iron roller 204, so that if the amount of the toner is smaller than a prescribed amount, the detour path curl applying unit 200B applies a curl to the sheet, and if the amount of the toner is equal or larger than the prescribed amount, the detour path curl applying unit 200B does not apply a curl to the sheet.

As described above, in the image forming apparatus of the present exemplary embodiment, in addition to achieving high speed of the sheet conveyance rate, the curl can be efficiently and appropriately applied to the sheet which is conveyed on the detour conveyance path 15*b* and the sheet which is conveyed on the second conveyance path 15*t*, respectively. Accordingly, the failure in entering the sheet into the fixing device is reduced when the image is formed on the second surface of the sheet.

Second Exemplary Embodiment

In the second exemplary embodiment, the configuration of the fixing device and the curl applying apparatus are different from the first exemplary embodiment. Only the difference in the second exemplary embodiment will be described, and the detailed explanation about the configuration identical to the first exemplary embodiment will be omitted.

Figure 5:
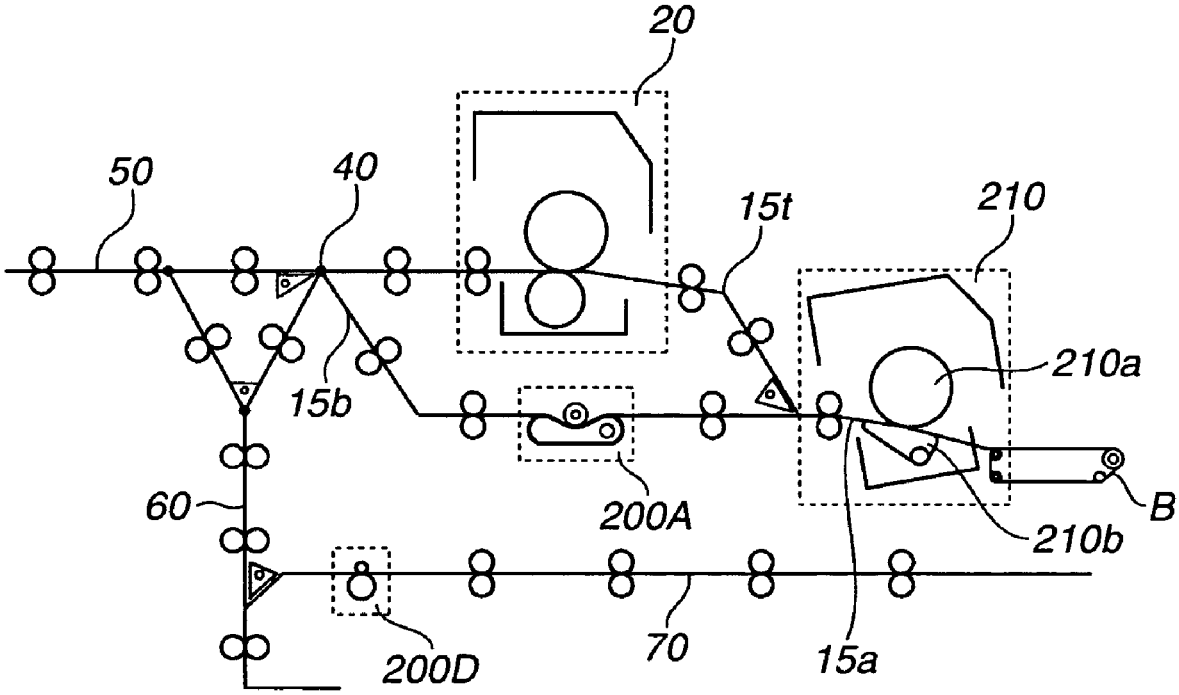
FIG. 5 is a schematic drawing of the conveyance unit around the fixing device in accordance with a second exemplary embodiment.

FIG. 5 is the cross section around the fixing device according to the second exemplary embodiment. As shown in FIG. 5, in the present exemplary embodiment, a first fixing device 210 on the upstream side is a belt-type fixing device including a fixing roller 210*a* and a fixing belt 210*b*.

In the case of the roller type fixing device 10 as shown in the first exemplary embodiment, a temperature of the lower roller follows a temperature of the upper roller. Accordingly, a temperature difference between the upper roller and the lower roller is small. However, in the belt-type fixing device according to the present exemplary embodiment, in order to secure the fixing property, the temperatures of the fixing roller 210*a* and a fixing belt 210*b* are separately controlled. Therefore, the temperature difference between the fixing roller 210*a* and the fixing belt 210*b* is larger than the roller-type, so that the curl becomes larger as compared with the roller type. Similar to the first exemplary embodiment, the curl becomes larger especially in the case of the thin paper, so that the curl correction cannot be sufficiently conducted with the conventional configuration.

Figure 6:
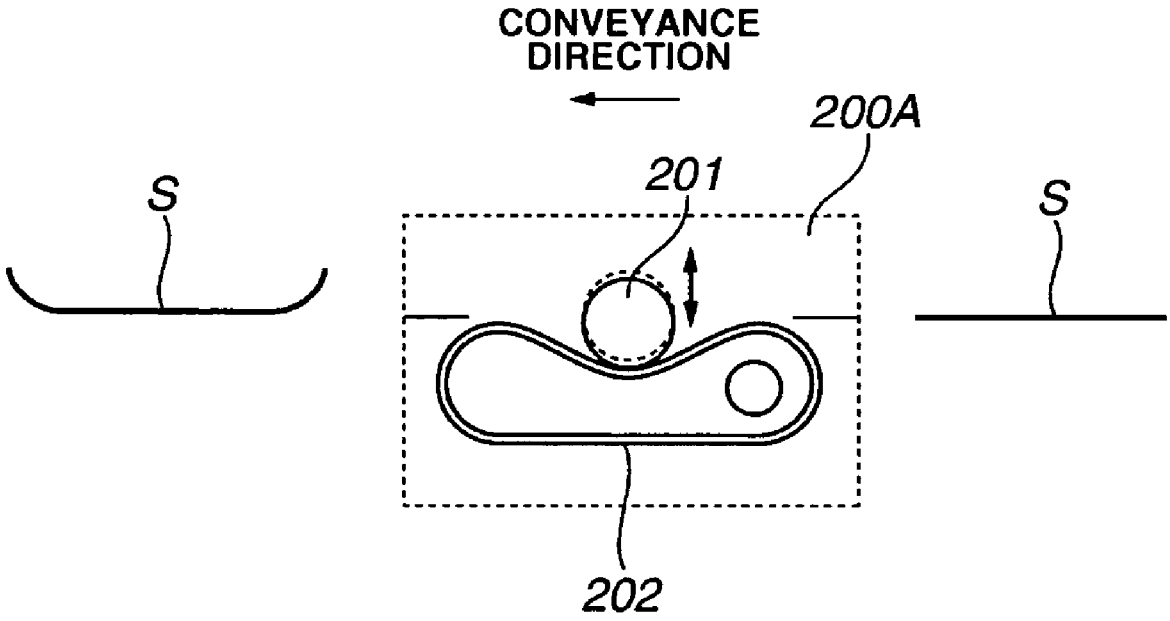
FIG. 6 is a detailed drawing of the curl applying unit in accordance with the second exemplary embodiment.

Accordingly, a detour path curl applying unit 200A is disposed on the detour conveyance path 15*b* so that the curl correction of the thin paper is sufficiently conducted. In the present exemplary embodiment, the detour path curl applying unit 200A on the detour conveyance path 15*b* includes a roller 201 and a belt 202 as shown in FIG. 6. When the curl applying unit uses a belt, some modifications in the conveyance path is required in comparison to the conventional configuration of the roller pair according to the first exemplary embodiment. However, the capability of the curl applying unit to apply the curl is higher, and can be driven at a low torque. Therefore, the present exemplary embodiment is an effective method when a higher curl correction capability is required.

In the present exemplary embodiment, the curl correction is conducted similarly to the first exemplary embodiment, and the failure in entering the sheet into the fixing device can be avoided when two-sided printing is carried out. Also, a decline in the registration precision is eliminated. Moreover, the detour path curl applying unit 200A according to the present exemplary embodiment can be configured such that the curl correction capability is adjusted by stepwise entering the iron roller 201 to the belt 202. In this embodiment, a curl correction amount of the detour path curl applying unit 200A is changed in according to the amount of the toner in a sheet. The control unit M controls the amount of going into the belt 202 of the iron roller 201, so that if the amount of the toner is smaller than a prescribed amount, the detour path curl applying unit 200A applies a curl to the sheet, and if the amount of the toner is equal or larger than the prescribed amount, the detour path curl applying unit 200A does not apply a curl to the sheet.

Third Exemplary Embodiment

The third exemplary embodiment is described below with reference to FIG. 7. The third exemplary embodiment is different from the first exemplary embodiment in that another curl applying unit is disposed near the upstream of a discharge roller D. Only the difference in the third exemplary embodiment will be described, and the detailed explanation about the configuration identical to the first exemplary embodiment will be omitted.

Figure 7:
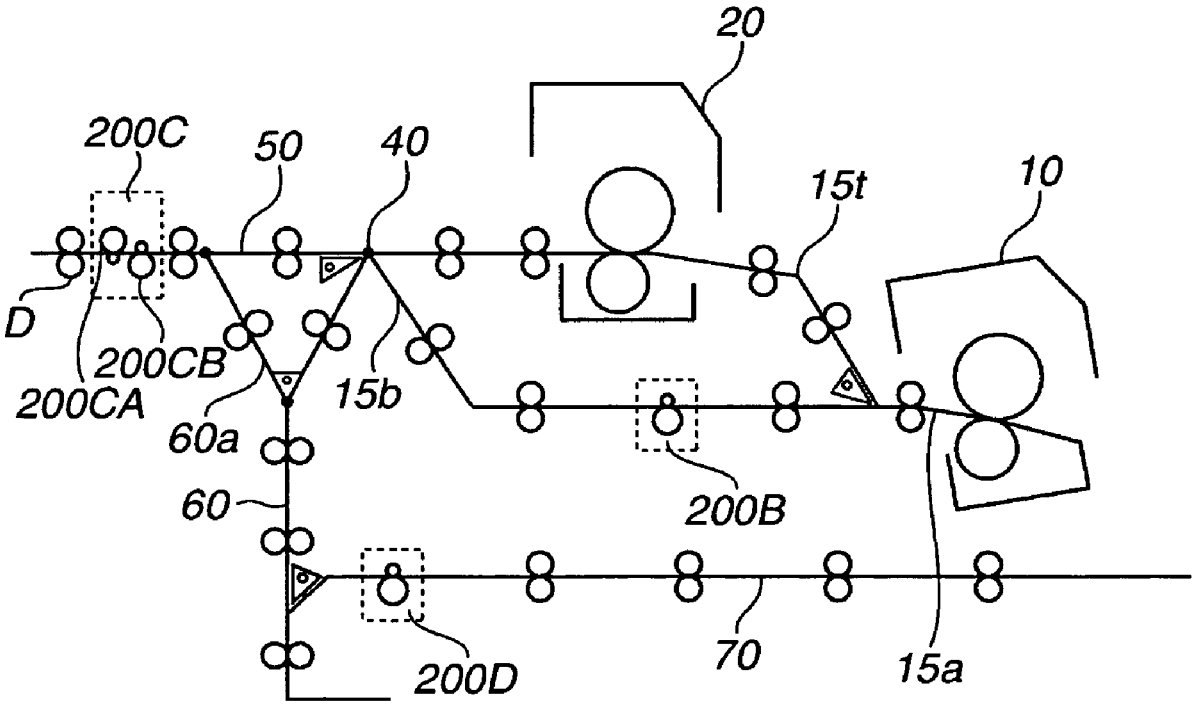
FIG. 7 is a schematic drawing of the conveyance unit around the fixing device in accordance with a third exemplary embodiment.
Figure 11:
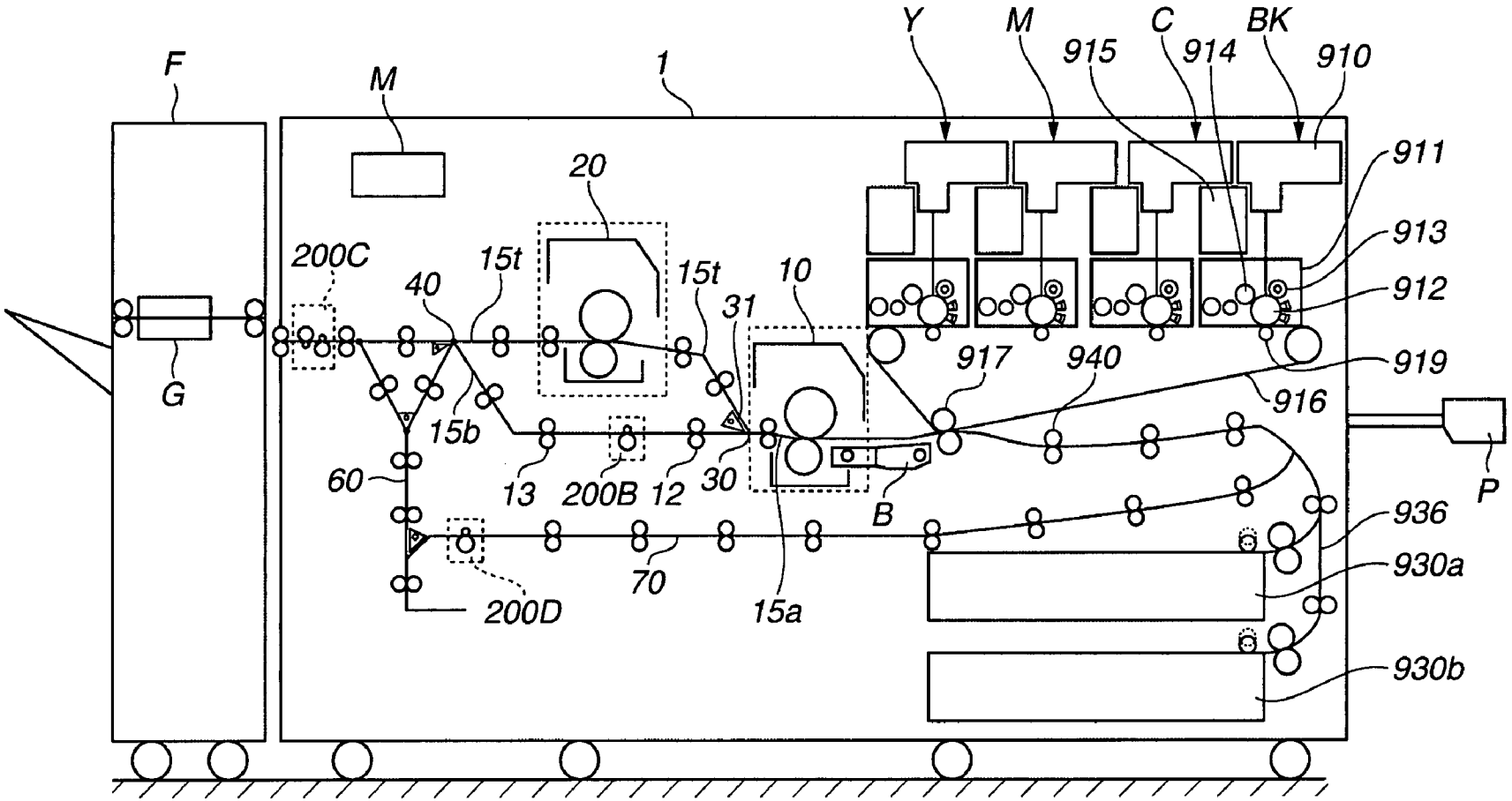
FIG. 11 is a cross sectional drawing of the image forming apparatus in accordance with the third exemplary embodiment.

In the third exemplary embodiment, as shown in FIG. 7, in the image forming apparatus described in the first exemplary embodiment, a curl applying unit 200C is further disposed as a first curl applying apparatus on a sheet discharge conveyance path (merged conveyance path) 50. The sheet discharge conveyance path 50 conveys the sheet to the sheet discharge roller pair D in a discharge slot. The curl correction is possible in two-sided printing according to the two exemplary embodiments described above. According to the present exemplary embodiment, furthermore, a condition of the sheet can be made appropriate, when a sheet is handed over to a later processing apparatus F or the one-sided printing is performed, in a case where the later processing apparatus F is connected to the image forming apparatus (refer to FIG. 11). Further, even though the later processing apparatus F is not connected to the image forming apparatus 1, the loading of the sheet on a sheet discharge tray H is improved in the present embodiment.

The curl applying unit 200C disposed on the sheet discharge conveyance path 50 shows an effect also in the one-sided printing. The effect is similar to that in the curl applying unit 200D on the two-sided conveyance path according to the exemplary embodiments as described above. Therefore, the curl applying unit 200C can more effectively correct the curl of the discharged sheet to a sufficient degree than the conventional device. This can reduce the paper jam at the time of delivery to the later processing apparatus F, and the decline of the sheet coordination precision at a coordinating unit G inside the later processing apparatus F.

Moreover, as already described in the exemplary embodiments, when the correction of the curl has to be carried out only with the curl applying unit 200C on the sheet discharge conveyance path, the correction is not sufficiently achieved. Since the temperature of the thin paper has been decreased, forced correction of the curl damages the sheet S. Moreover, when the sheets of different thickness are conveyed at high speed, the operation becomes complex because the correction capability has to be adjusted between the sheets. In addition, a problem of durability arises. In the configuration of the present exemplary embodiment, these problems are solved by disposing the curl applying unit on both the detour conveyance path 15*b* and the sheet discharge conveyance path 50. In this embodiment, a curl correction amount of the detour path curl applying unit 200B is changed in according to the amount of the toner in a sheet. The control unit M controls the amount of going into the sponge roller 203 of the iron roller 204, so that if the amount of the toner is smaller than a prescribed amount, the detour path curl applying unit 200B applies a curl to the sheet, and if the amount of the toner is equal or larger than the prescribed amount, the detour path curl applying unit 200B does not apply a curl to the sheet.

Further, the curl applying unit 200C on the sheet discharge conveyance path according to the present exemplary embodiment includes a first curl removing roller pair 200CA and a second curl removing roller pair 200CB which apply curls in opposite directions from one another. The directions of the curls applied on the sheet can be changed by selectively using the two curl removing roller pairs 200CA and 200CB.

Fourth Embodiment

The configuration of the fourth exemplary embodiment is different from the first exemplary embodiment in following points. A curl applying unit 200F disposed around the entrance of the two-sided conveyance path 70 corrects the curl in an opposite direction from the detour path curl applying unit 200B on the detour conveyance path 15*b*. Only the difference in the fourth exemplary embodiment will be described, and the detailed explanation about the configuration identical to the third exemplary embodiment will be omitted.

Figure 8:
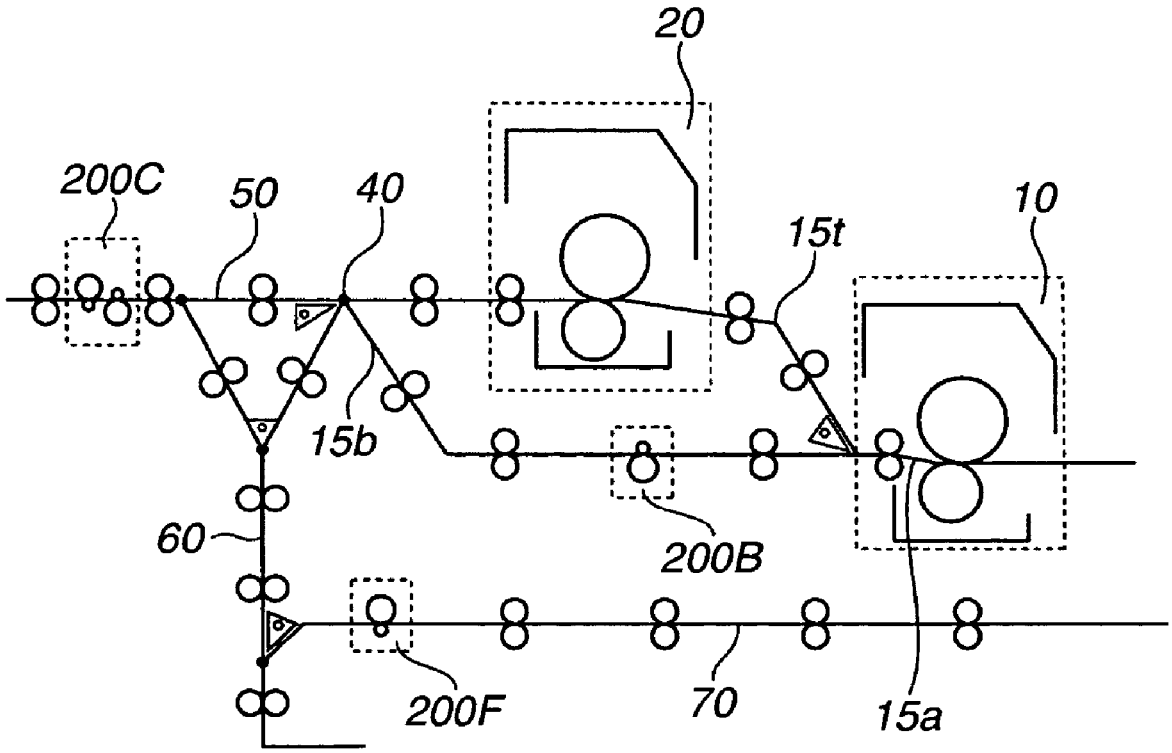
FIG. 8 is a schematic drawing of the conveyance unit around the fixing device in accordance with a fourth exemplary embodiment.

FIG. 8 is a drawing showing the cross section around the fixing device according to the fourth exemplary embodiment.

According to the fourth exemplary embodiment, as shown in FIG. 8, the curl correcting unit 200F on the two-sided conveyance path that is disposed around the entrance of the two-sided conveyance path 70 is configured to correct the curl in the opposite direction from the detour path curl applying unit 200B. When the thin paper is corrected sufficiently at the detour path curl applying unit 200B, and when the curl does not affect the thick paper, the direction in which the curl is applied by the two-sided conveyance curl applying unit 200F is set to be the opposite from the detour path curl applying unit 200B. Therefore, the curl applying unit 200F can be used to eliminate the effect of the toner curl. The toner curl gradually grows larger after fixing the toner. Accordingly, the curl applying unit 200F is disposed on the two-sided conveyance path 70 and the curl can be kept minimum before it grows larger. Thus, the effect at the time of paper discharge can be small.

In other words, the curl applying unit 200F on the two-sided conveyance path applies a curl in a convex direction of a sheet surface where the toner image is formed. The detour path curl applying unit 200B applies a curl in a convex direction of a surface that is opposite to the sheet surface where the toner image is formed. Owing to this configuration, the curl correction is conducted in response to respective formation of the heat curl and toner curl that have different curl directions. Therefore, the curl correction can be facilitated.

Figure 9:
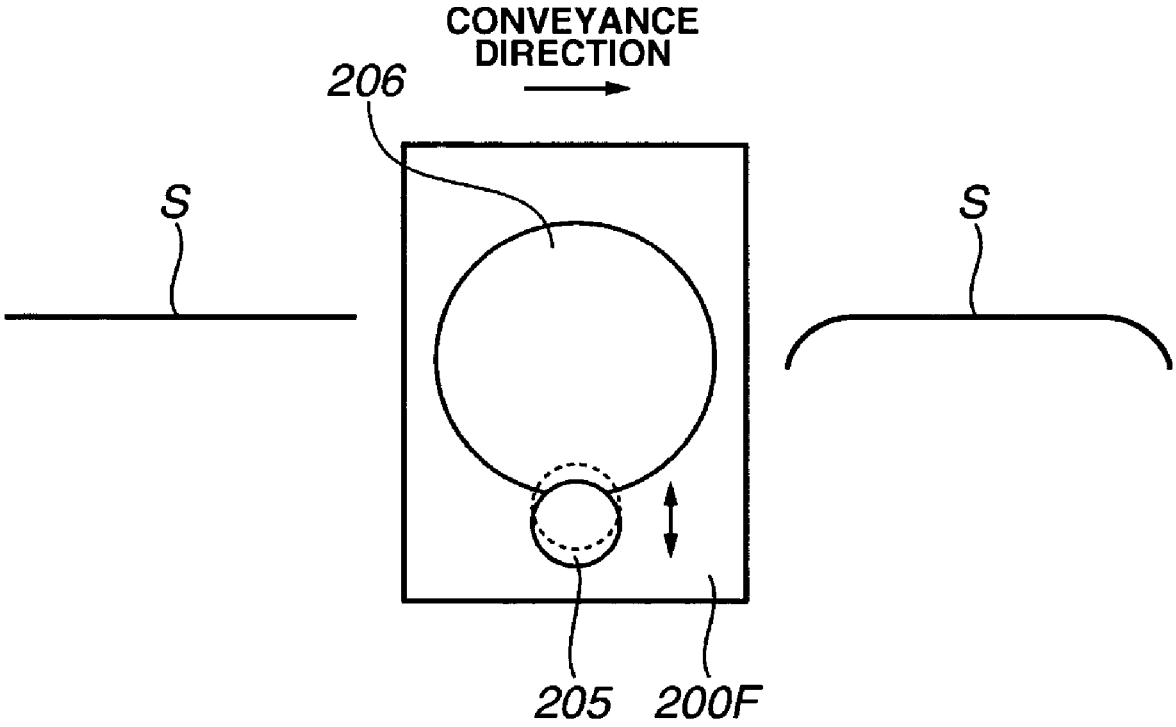
FIG. 9 is a detailed drawing of the curl applying unit in accordance with the fourth exemplary embodiment.

Moreover, the curl applying unit 200F as shown in FIG. 9 may be configured to adjust its correction capability by entering the roller 205 stepwise to the roller 206.

Whether to set the direction of the curl applied by the two-sided conveyance path curl applying unit to be the same direction as the detour path curl applying unit of the first exemplary embodiment, or to set to be the different direction as in the fourth exemplary embodiment, may be decided depending on influence degrees of the heat curl and toner curl.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-131836 filed Apr. 28, 2005, which is hereby incorporated by reference herein in its entirety.

What is claimed is:

1. An image forming apparatus, comprising:

an image forming unit configured to form a toner image on a sheet;

a first fixing device fixing the toner image formed on the sheet by the image forming unit;

a second fixing device fixing the toner image on the sheet carrying the toner image fixed by the first fixing device;

a fixing conveyance path guiding the sheet carrying the toner image fixed by the second fixing device;

a detour conveyance path diverging from the fixing conveyance path on an upstream side of the second fixing device, and joining the fixing conveyance path at a joining point on a downstream side of the second fixing device so that the sheet is guided detouring the second fixing device;

a joined conveyance path guiding the sheet on a downstream side of the joining point;

a first curl applying unit disposed on the joined conveyance path and applying a curl to the sheet; and a second curl applying unit disposed on the detour conveyance path and applying a curl to the sheet.

2. The image forming apparatus according to claim 1, further comprising:

a conveyance path switching member selectively guiding the sheet to one of the detour conveyance path and the fixing conveyance path, wherein the conveyance path switching member being rotatably disposed on a divergence point at which the detour conveyance path diverges from the fixing conveyance path; and a control unit controlling rotational movement of the conveyance path switching member by guiding the sheet to the fixing conveyance path when an image is formed on a thick sheet, and by guiding the sheet to the detour conveyance path when an image is formed on a sheet thinner than the thick sheet.

3. The image forming apparatus according to claim 1, wherein the joined conveyance path includes a reversing conveyance path that reverses the sheet, and a two-sided conveyance path that conveys the sheet reversed by the reversing conveyance path to the image forming unit again, wherein the first curl applying unit is disposed on the two-sided conveyance path.

4. The image forming apparatus according to claim 1, wherein the joined conveyance path is a discharge conveyance path that conveys the sheet to a discharge unit discharging the sheet outside of the apparatus, wherein the first curl applying unit is disposed on the discharge conveyance path.

5. The image forming apparatus according to claim 1, further comprising not more than two roller pairs that convey the sheet, disposed between the first fixing device and the second curl applying unit.

6. The image forming apparatus according to claim 1, wherein the first curl applying unit and the second curl applying unit apply the curl to the sheet in substantially the same direction.

7. The image forming apparatus according to claim 1, wherein the first curl applying unit applies a curl in a convex direction of the sheet surface where the toner image is formed, and wherein the second curl applying unit applies a curl in a convex direction of a surface opposite to the sheet surface where the toner image is formed.

8. The image forming apparatus according to claim 1, wherein each of the first curl applying unit and the second curl applying unit includes a soft material and a hard material, wherein the sheet is sandwiched between the soft material and the hard material when the first and second curl applying units apply the curl to the sheet.

9. The image forming apparatus according to claim 1, wherein one of the first curl applying unit and the second curl applying unit includes an elastic belt and a hard roller.

10. The image forming apparatus according to claim 1, wherein one of the first curl applying unit and the second curl applying unit is configured to stepwise adjust its curl correcting capability.

11. The image forming apparatus according to claim 10, wherein the stepwise correcting capability of the first curl applying unit or the second curl applying unit is controlled according to sheet type information input from an operation unit.

12. A fixing device for fixing a toner image formed on a sheet, comprising:

a first conveyance path where the sheet passes through;

a first fixing device fixing the toner image on the sheet passing through the first conveyance path;

a second fixing device on a downstream side of the first fixing device;

a second conveyance path diverging from the first conveyance path between the first fixing device and the second fixing device, and joining the first conveyance path at a joining point on a downstream side of the second fixing device;

a joined conveyance path where a sheet having passed through the first conveyance path and a sheet having passed through the second conveyance path, pass, on a downstream side of the joining point;

a first curl applying apparatus that is disposed on the joined conveyance path and applies a curl to the sheet; and a second curl applying apparatus that is disposed on the second conveyance path and applies a curl to the sheet.

13. The fixing device according to claim 12, further comprising:

a conveyance path switching member that selectively guides the sheet to one of the first conveyance path and the second conveyance path, the switching member being rotatably disposed at a diverging point of the first conveyance path and the second conveyance path; and a control unit controlling rotational movement of the conveyance path switching member so that a sheet is guided to the first conveyance path when an image is formed on a thick sheet, and a sheet is guided to the second conveyance path when an image is formed on a sheet thinner than the thick sheet.

* * * * *